US007621131B2

(12) United States Patent
Von Der Bank

(10) Patent No.: US 7,621,131 B2
(45) Date of Patent: Nov. 24, 2009

(54) BURNER FOR A GAS-TURBINE COMBUSTION CHAMBER

(75) Inventor: Ralf Sebastian Von Der Bank, Rangsdorf (DE)

(73) Assignee: Rolls-Royce Deutschland Ltd & Co. KG (DE)

( * ) Notice: Subject to any disclaimer, the term of this patent is extended or adjusted under 35 U.S.C. 154(b) by 474 days.

(21) Appl. No.: 10/860,659

(22) Filed: Jun. 4, 2004

(65) Prior Publication Data

US 2005/0028526 A1 Feb. 10, 2005

(30) Foreign Application Priority Data

Jun. 6, 2003 (DE) ..... 103 26 720

(51) Int. Cl.
*F02C 1/00* (2006.01)
*F02G 3/00* (2006.01)

(52) U.S. Cl. ..... 60/737; 60/740; 60/748

(58) Field of Classification Search ..... 60/737, 60/740, 747, 748, 742
See application file for complete search history.

(56) References Cited

U.S. PATENT DOCUMENTS

| | | | | |
|---|---|---|---|---|
| 3,961,475 | A * | 6/1976 | Wood | 60/738 |
| 5,216,885 | A * | 6/1993 | Taniguchi et al. | 60/737 |
| 5,319,936 | A * | 6/1994 | Ikeda et al. | 60/737 |
| 5,325,660 | A * | 7/1994 | Taniguchi et al. | 60/776 |
| 5,367,873 | A | 11/1994 | Barcza et al. | |
| 5,575,153 | A * | 11/1996 | Ito et al. | 60/737 |
| 5,630,320 | A * | 5/1997 | Matsuda et al. | 60/749 |
| 5,737,921 | A * | 4/1998 | Jones et al. | 60/740 |
| 6,056,538 | A | 5/2000 | Buchner et al. | |
| 6,199,367 | B1 * | 3/2001 | Howell | 60/39.23 |
| 6,272,840 | B1 * | 8/2001 | Crocker et al. | 60/776 |
| 6,968,692 | B2 * | 11/2005 | Chin et al. | 60/737 |
| 6,986,255 | B2 * | 1/2006 | Smith et al. | 60/776 |
| 7,114,337 | B2 * | 10/2006 | Cazalens et al. | 60/737 |
| 2002/0011064 | A1 * | 1/2002 | Crocker et al. | 60/39.06 |
| 2004/0035114 | A1 * | 2/2004 | Hayashi et al. | 60/737 |
| 2004/0079086 | A1 * | 4/2004 | Smith et al. | 60/776 |

(Continued)

FOREIGN PATENT DOCUMENTS

DE 12 54 911 B 11/1967

(Continued)

OTHER PUBLICATIONS

German Search Report dated Mar. 3, 2004.

*Primary Examiner*—William H Rodriguez
(74) *Attorney, Agent, or Firm*—Timothy J. Klima; Shuttleworth & Ingersoll, PLC

(57) ABSTRACT

On a burner for a gas-turbine combustion chamber which comprises a lean premix burner with centrally integrated stabilizing burner, a core air annulus (11) accommodating the atomizer nozzle (10) of the stabilizing burner is concentrically surrounded by a main air annulus (4) supplying the weak air-fuel mixture. In the adjacent issuing areas of the main air annulus and the core air annulus, a flame stabilization ring (13), which is heated by the combustion gases and whose cross-sectional surface increases in area toward the combustion chamber (5), is provided to produce an approximately hollow-cylindrical hot-gas recirculation zone (17) originating at the flame stabilization ring which ensures a stable flame formation throughout the range of operating conditions of the gas turbine.

19 Claims, 2 Drawing Sheets

U.S. PATENT DOCUMENTS

| | | | | |
|---|---|---|---|---|
| 2007/0028619 | A1* | 2/2007 | Spooner | 60/737 |
| 2007/0157617 | A1* | 7/2007 | von der Bank | 60/743 |
| 2007/0289306 | A1* | 12/2007 | Suria et al. | 60/748 |

FOREIGN PATENT DOCUMENTS

| | | | |
|---|---|---|---|
| DE | 37 39 197 | A1 | 6/1988 |
| DE | 4422532 | | 1/1996 |
| EP | 0 660 038 | A2 | 6/1995 |
| EP | 066038 | | 6/1995 |
| EP | 0 845 634 | A2 | 6/1998 |
| EP | 0931979 | | 7/1999 |
| EP | 1 134 494 | A1 | 9/2001 |
| EP | 1 186 832 | A2 | 3/2002 |
| JP | 59 129330 | A | 7/1984 |
| WO | 03/091557 | | 11/2003 |

* cited by examiner

BURNER FOR A GAS-TURBINE COMBUSTION CHAMBER

This application claims priority to German Patent Application DE10326720.4 filed Jun. 6, 2003, the entirety of which is incorporated by reference herein.

BACKGROUND OF THE INVENTION

This invention relates to a burner for a gas-turbine combustion chamber, in particular for an aircraft gas turbine, which comprises a lean premix burner with centrally integrated stabilizing burner.

Lean premix burners for gas-turbine engines and for gas turbines in other applications whose combustion chambers burn a fuel-air mixture with high content of air at low combustion temperature and correspondingly reduced nitrogen oxide formation are generally known. The use of such burners is, however, disadvantageous in that the stability of the flame is not ensured. In other words, the air-fuel mixture supplied to the combustion chamber will not burn or be ignited continuously as the combustion temperature falls, as a result of which the flame will fluctuate or may even go out. On gas-turbine engines for aircraft, this problem exists, in particular, at low ambient temperatures, in hail or rain showers or under similar, adverse meteorological conditions resulting in a reduced temperature of the air-fuel mixture. For ignition of the air-fuel mixture, a sufficiently high air temperature is required to rapidly vaporize the liquid fuel supplied to the combustion chamber as droplet mist, preheat it to a temperature as high as possible, depending on the composition of the fuel-air mixture and, thus, facilitate ignition.

In order to ensure ignition of the air-fuel mixture at any time, an ignition or stabilizing burner is, as is generally known, allocated to the lean premix burners arranged in the combustion chamber which produces a high combustion temperature with an air-fuel mixture with higher fuel content (rich mixture) to enable ignition of the air-fuel mixture supplied by the lean premix burner or main burner, which due to its weakness delivers a low combustion temperature, even at low air temperatures and correspondingly unfavorable vaporization behavior of the liquid fuel and to ensure the stability of the flame.

Normally, combustion chambers including lean premix burners with stabilizing means are of the staged design, with a stabilizing burner being allocated separately to each main/lean premix burner in a laterally staged arrangement. Besides complexity, high number of parts, high manufacturing costs and high weight, cooling of the large surfaces involves considerable investment. These combustion chamber concepts are generally known as "axially staged combustion chambers" or "dual annular combustion chambers".

Other types of lean premix burners using stabilizing means in which the ignition burner is centrally integrated do not have the design disadvantages described above, but are not considered successful since they fail to satisfy both a lean overall ratio of the air-fuel mixture required and stable operation of the centrally arranged stabilizing burner. Particularly critical here are idle operation of the gas turbine where the air entry temperature to the combustion chamber is particularly low and run-up of the gas turbine upon engine start when in part very high total air-fuel mixture ratios are to be handled. Besides this, transient operating points must be flyable: Particularly unfavorable here is the transition from part load in cruise to flight idle in descent.

Further, maneuvers are encountered in which engine thrust must be reduced very rapidly, with the decrease in fuel flow leading to extremely weak air-fuel ratios. In addition, all these unfavorable operating points must, as already mentioned, be flyable under extreme meteorological conditions, such as hailstorms or tropical rain. Furthermore, such conditions must be manageable as they are encountered during re-start of the engine or re-light of the combustion chamber at elevated altitudes, i.e. under atmospheric conditions with very low pressure and low temperature (up to minus 56° C.).

A burner combination of the type mentioned above, which comprises a main burner with centrally integrated stabilizing burner, is described in Specification EP 0 660 038 B1, for example. This burner comprises a main burner with an annular, external fuel-air mixing duct for the production of a fuel-air mixture to be supplied to the combustion chamber and a stabilizing burner provided in an axial duct of a central body, i.e. centrally located in the main burner, at whose exit port fuel is sprayed and is introduced, mixed with core air, into the gas-turbine combustion chamber. A flame formation which is stable throughout the range of operating conditions can, however, not be achieved With this burner design.

BRIEF SUMMARY OF THE INVENTION

The present invention, in a broad aspect, provides a burner of the type mentioned above which ensures stability of the flame in the combustion chamber throughout the operating range of a gas-turbine engine and safe operation of the gas turbine at any time.

It is a particular object of the present invention to provide solution to the above problems by a burner for a gas-turbine combustion chamber designed in accordance with the features described herein. Further features and advantageous embodiments of the present invention will become apparent from the description below.

The idea underlying the present invention with respect to a lean premix burner with a weak air-fuel mixture supplied via a main air annulus and a stabilizing burner integrated centrally into the lean premix burner with a core air annulus surrounded by the main air annulus and with an atomizer nozzle for fuel arranged at the exit port of the core air annulus is to provide, in the adjacent issuing areas of the concentric annuli, a flame stabilization ring which is highly heated by the combustion process and whose air deflector flanks direct the main air-fuel mixture outwards and the core airflow inwards. The gas flow produced by the hot flame stabilization ring effects the formation of a hot, approximately hollow-cylindrical to barrel-shaped, steady recirculation zone or hot-gas zone which originates at the flame stabilization ring and, together with the stabilization ring, acts as an igniting element and in which the fuel discharged from the stabilizing burner is caught and completely burnt. The flame stabilization ring in accordance with the present invention ensures that a stable, non-extinguishing flame is provided in any operating state of a gas turbine equipped with a lean premix burner and integrated stabilizing burner, even if external conditions lead to a decrease of the air temperature, thus ensuring the operational reliability of the gas-turbine engine.

In accordance with a further, feature of the present invention, the flame stabilization ring is an annular ring having a generally triangular cross-section incorporating a fillet which is enclosed by two legs and is open to the combustion chamber. The legs form, on the burner-facing side, the deflector flanks for the inwardly flowing core air or the outwardly flowing main air-fuel mixture, respectively. Simultaneously, the fillet or the legs, respectively, of the flame stabilization ring provide the cooling necessary to prevent the ring from overheating. Cooling is effected at the air deflector flanks of the relatively thin-walled legs of the flame stabilization ring by the core or main air supplied.

In a further development of the present invention, the flame stabilization ring comprises a heat-stable or high-temperature resistant material or a material which is provided with a high-temperature coating on the flame side. The flame stabilization ring connects with its apex to the face of the central body which separates the core air annulus from the main air annulus.

BRIEF DESCRIPTION OF THE DRAWINGS

The present invention is more fully described in light of the accompanying drawings showing a preferred embodiment. In the drawings.

DETAILED DESCRIPTION OF THE INVENTION

Figure 1:
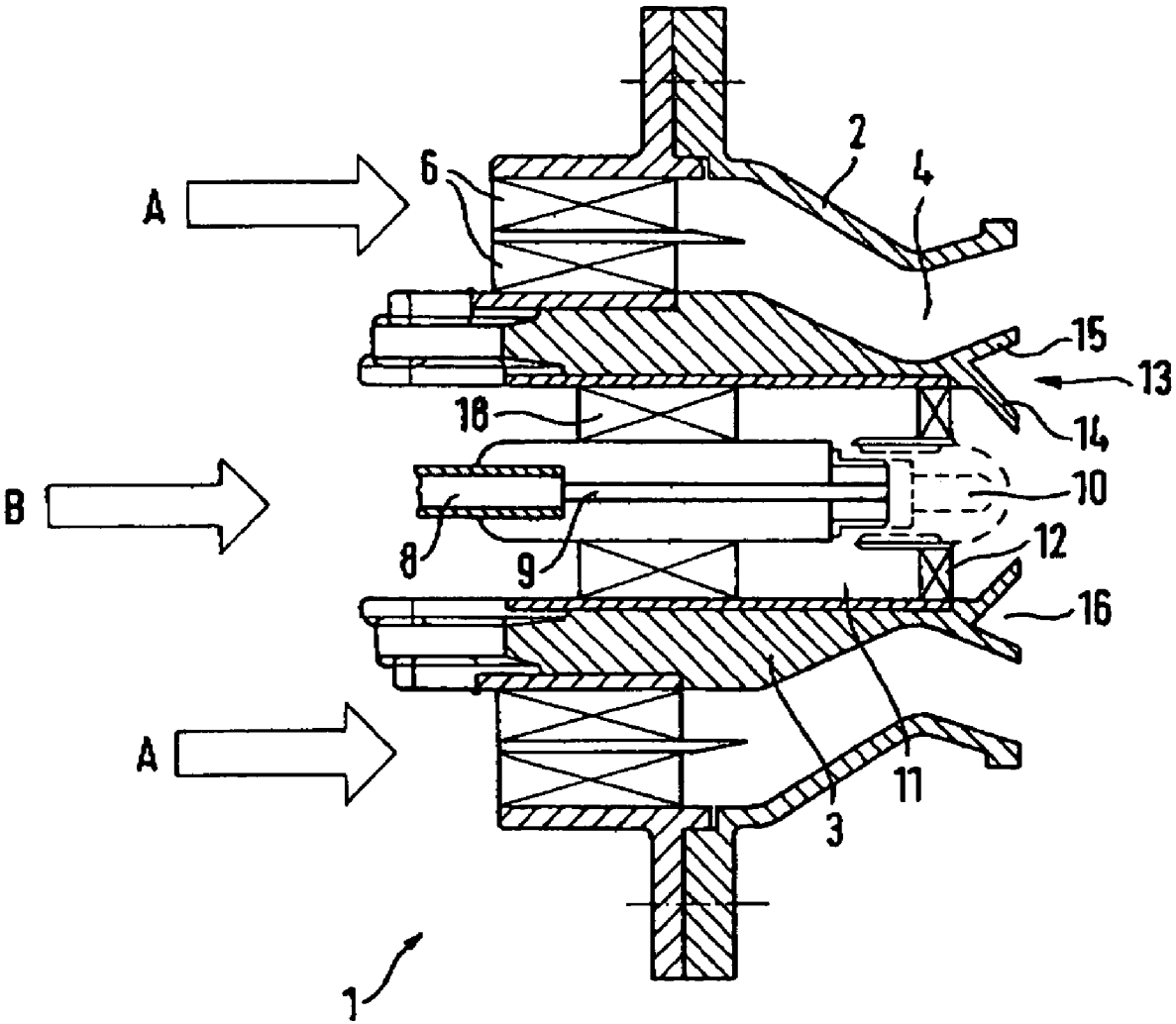
FIG. 1 is a sectional view of a lean premix burner with centrally integrated stabilizing burner allocated to the combustion chamber of an aircraft gas turbine.
Figure 2:
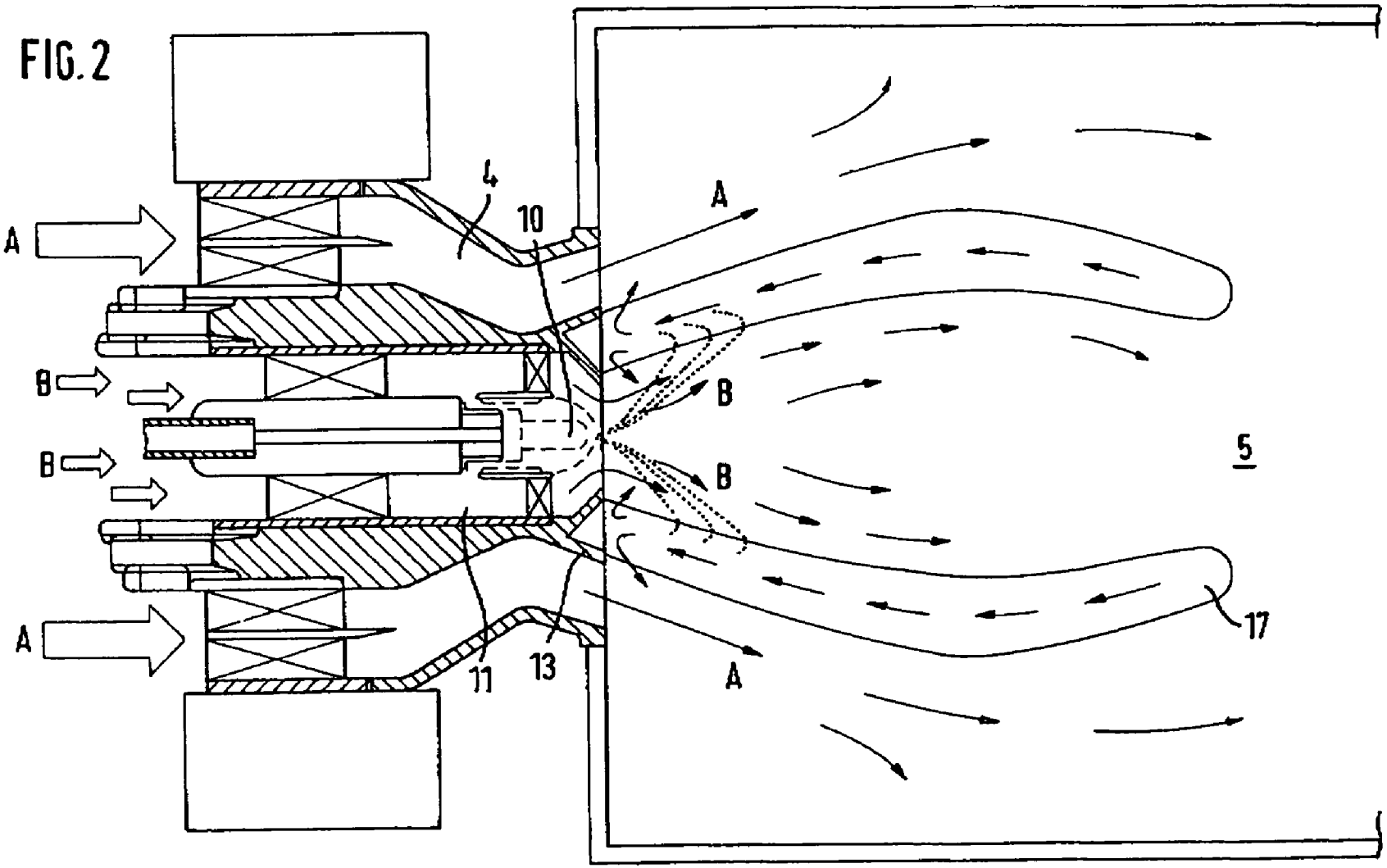
FIG. 2 shows the burner arrangement as per FIG. 1, however detailing the fuel and air flows as well as the hot gas or recirculation zone provided in the gas turbine combustion chamber.

The burner 1 has a casing 2 and a central body 3 between which a main air annulus 4 for a main or lean premix burner associated with a combustion chamber 5 of an (aircraft) gas turbine is formed. The main air annulus 4 of the lean premix burner, through which flow approximately 90 percent of the total combustion air, contains main air swirlers 6 which impart a rotational movement to the main air flow—arrow A. Liquid fuel is injected into the swirling main air flow which mixes with, and partly vaporizes in, this hot air flow. The—lean—fuel-air mixture supplied to the combustion chamber 5 has a high air content and, accordingly, burns in the combustion chamber 5 with low combustion temperature, as a result of which nitrogen oxide emissions and air pollution are extremely low.

While low pollutant emission is obtained with low combustion temperatures, the reduced air entry temperature associated with it may lead to flame instabilities or flame blow out, in particular, under adverse meteorological conditions.

To ensure the safe formation of the flame, for example, for rapid acceleration or deceleration of the gas turbine, and to avoid flame-out, the central body 3 is provided with a duct 7 which extends along the central axis of the central body 3 and which accommodates a stabilizing burner consisting of an atomizer, more precisely of atomizer fins 18, a fuel line 8, an atomizer carrier tube 9 connecting to the fuel line 8 and an atomizer nozzle 10 issuing to the combustion chamber 5 as well as a core air annulus 11 provided on the periphery of the atomizer. The core air supplied in the direction of arrow B passes via the core air annulus 11 and a core air swirler 12, which imparts an axial rotational movement to the core air, into the gas turbine combustion chamber 5 to provide there, with the fuel spray from the atomizer nozzle 10, a fuel-air mixture with high fuel content to produce a stable flame. The directions of rotation of the main airflow and the core airflow are preferably the same. The present lean premix burner with centrally integrated stabilizing burner includes a flame stabilization ring 13 connecting to the central body 3 in the issuing areas of the core air annulus 11 and the main air annulus 4 which is designed as an annular ring having a generally triangular cross-section (or sweep) whose apex connects to the central body 3 and whose fillet 16 (open end), formed by an annular core air deflector flank 14 and an annular main air deflector flank 15, faces the interior of the combustion chamber 5. The core airflow deflected inwards by the core air deflector flank 14 and the outward main airflow produced by the main air deflector flank 15 form, in the combustion chamber 5, a steady recirculation zone 17 of maximum temperature (hot gas zone) which originates at the fillet 16 and is essentially hollow-cylindrical and barrel-shaped, i.e. a stable flame zone whose flame root lies in the fillet 16, with the velocities of the flows produced by the main air annulus 4 and the core air annulus 11 compensating each other in the recirculation zone 17. This steady, hot recirculation zone 17 allows the fuel mist from the atomizer nozzle 10 which failed to vaporize due to the cold air supplied under adverse meteorological conditions, to enter this zone or to dwell sufficiently long to be maximally vaporized to form a well-burning and ignitable fuel-air mixture in the combustion chamber. The fuel discharge angle at the atomizer nozzle 10 is set such that the fuel droplets meet, and are burnt in, the hot, steady recirculation zone 17, but do not get beyond this zone onto the combustion chamber walls. In a preferred embodiment, this angle is between 60 and 130 degrees, and more preferably, about 95 degrees.

The formation of the barrel-shaped, hollow-cylindrical, hot recirculation zone 17 is essentially supported by the heating of the flame stabilization ring 13, with the fillet 16 whose surface, heated by the flame root located there, also contributes to the ignition of the fuel, or the fuel-air mixture, respectively, to maintain combustion. The flame stabilization ring 13 can be constructed of heat-resistant steel, if necessary with a ceramic protective coating applied to the flame side, or fully of ceramic material (preferably fiber ceramic composites). Overheating of the flame stabilization ring 13 is prevented by suitable material selection and by the good heat transfer at the relatively thin-walled core air and main air deflection flanks 14, 15 of the flame stabilization ring 13 and the main air (air-fuel mixture) or core air, respectively, passing along the rear of the flame stabilization ring 13 and acting as cooling medium.

When in the form as shown, preferably the fillet 16 has an angle of approximately 90 degrees between the deflector flanks 14 and 15. However, this angle can be altered to any desired angle, or combination of angles. The fillet 16 can also have other configurations, such as being U-shaped or bell-shaped in cross-section, for example.

| List of reference numerals | |
|---|---|
| 1 | Burner |
| 2 | Casing |
| 3 | Central body |
| 4 | Main air annulus |
| 5 | Gas turbine combustion chamber |
| 6 | Main air swirler |
| 7 | Duct |
| 8 | Fuel line |
| 9 | Atomizer carrier tube |
| 10 | Atomizer nozzle |
| 11 | Core air annulus |
| 12 | Core air swirler |
| 13 | Flame stabilization ring |
| 14 | Core air deflector flank |
| 15 | Main air deflector flank |
| 16 | Fillet |
| 17 | Recirculation zone, hot gas zone |
| 18 | Atomizer fins |
| Arrow A | Main airflow, air-fuel mixture |
| Arrow B | Core airflow |

What is claimed is:

1. A burner for a gas-turbine combustion chamber which comprises a lean premix burner with centrally integrated stabilizing burner;

a core air annulus;

an atomizer nozzle of the stabilizing burner positioned in the core air annulus;

a single main air annulus of the lean premix burner surrounding the atomizer nozzle and core air annulus and supplying a weak air-fuel mixture;

a flame stabilization ring positioned directly between adjacent issuing areas of the core air and the single main air annulus, which includes a radially inwardly directed core air deflector flank extending into and partially blocking a core air flow and a radially outwardly directed main air deflector flank extending into and partially blocking a main air flow to create a substantial blockage area between the core air flow and the main air flow downstream of the flame stabilization ring to form a steady, approximately hollow-cylindrical, hot recirculation zone which originates at the flame stabilization ring, the recirculation zone retaining unvaporized fuel from the atomizer nozzle sufficiently long to more fully vaporize same and form a well-burning and ignitable air-mixture in the combustion chamber;

wherein the flame stabilization ring has a fillet on a side facing the gas-turbine combustion chamber.

2. A burner in accordance with claim 1, wherein the flame stabilization ring is an annular ring haying a generally triangular cross-section whose apex connects to a central body which separates the core air annulus from the main air annulus.

3. A burner in accordance with claim 2, wherein the flame stabilization ring is made of heat-resisting steel.

4. A burner in accordance with claim 3, wherein the flame stabilization ring is provided with a ceramic coating in an area of the fillet.

5. A burner in accordance with claim 2, wherein the flame stabilization ring is made of ceramic material.

6. A burner in accordance with claim 2, wherein a fuel discharge angle of the atomizer nozzle is between 60 and 130 degrees.

7. A burner in accordance with claim 6, wherein the fuel discharge angle is about 95 degrees.

8. A burner in accordance with claim 7, wherein core air and main air swirlers are positioned in the main air and the core air annulus, respectively.

9. A burner in accordance with claim 2, wherein core air and main air swirlers are positioned in the main air and the core air annulus, respectively.

10. A burner in accordance with claim 2, wherein the fillet has an angle of about 90 degrees.

11. A burner in accordance with claim 1, wherein a fuel discharge angle of the atomizer nozzle is between 60 and 130 degrees.

12. A burner in accordance with claim 11, wherein the fuel discharge angle is about 95 degrees.

13. A burner in accordance with claim 1, wherein core air and main air swirlers are positioned in the main air and the core air annulus, respectively.

14. A burner in accordance with claim 1, wherein the flame stabilization ring is made of heat-resisting steel.

15. A burner in accordance with claim 14, wherein the flame stabilization ring is provided with a ceramic coating in an area of the fillet.

16. A burner in accordance with claim 1, wherein the flame stabilization ring is made of ceramic material.

17. A burner in accordance with claim 1, wherein the fillet has an angle of about 90 degrees.

18. A burner in accordance with claim 1, wherein the atomizer nozzle has an outlet substantially even with a combustion side of the flame stabilization ring along an axis of the lean premix burner.

19. A burner for a gas-turbine combustion chamber which comprises a lean premix burner with centrally integrated stabilizing burner;

a core air annulus;

an atomizer nozzle of the stabilizing burner positioned in the core air annulus;

a single main air annulus of the lean premix burner surrounding the atomizer nozzle and core air annulus and supplying a weak air-fuel mixture;

a flame stabilization ring positioned directly between adjacent issuing areas of the core air and the single main air annulus, which includes an inwardly directed core air deflector flank and an outwardly directed main air deflector flank for the formation of a steady, approximately hollow-cylindrical, hot recirculation zone which originates at the flame stabilization ring;

wherein the flame stabilization ring has a fillet on a side facing the gas-turbine combustion chamber, and the atomizer nozzle has an outlet substantially even with a combustion side of the flame stabilization ring along an axis of the lean premix burner.

* * * * *